US009153373B2

(12) United States Patent
Hsu et al.

(10) Patent No.: US 9,153,373 B2
(45) **Date of Patent: *Oct. 6, 2015**

(54) TRANSFORMER HAVING ASSEMBLED BOBBINS AND VOLTAGE TRANSFORMATION MODULE HAVING THE TRANSFORMER

(71) Applicant: Chicony Power Technology Co., Ltd., New Taipei (TW)

(72) Inventors: Hao-Te Hsu, New Taipei (TW); Yung-Hung Hsiao, New Taipei (TW)

(73) Assignee: Chicony Power Technology Co., Ltd., New Taipei (TW)

( * ) Notice: Subject to any disclaimer, the term of this patent is extended or adjusted under 35 U.S.C. 154(b) by 11 days.

This patent is subject to a terminal disclaimer.

(21) Appl. No.: 14/071,857

(22) Filed: Nov. 5, 2013

(65) Prior Publication Data

US 2014/0062634 A1 Mar. 6, 2014

Related U.S. Application Data

(63) Continuation of application No. 13/540,930, filed on Jul. 3, 2012, now Pat. No. 8,669,838.

(51) Int. Cl.
*H01F 17/04* (2006.01)
*H01F 27/30* (2006.01)
(Continued)

(52) U.S. Cl.
CPC ..... *H01F 27/085* (2013.01); *H01F 27/2866* (2013.01); *H01F 27/306* (2013.01)

(58) Field of Classification Search
CPC ..... H01F 30/16; H01F 17/04; H01F 27/2847; H01F 3/10; H01F 30/10
USPC ..... 336/221, 185, 195–198, 201
See application file for complete search history.

(56) References Cited

U.S. PATENT DOCUMENTS 2,355,477 A * 8/1944 Stahl ..... 242/118.7
5,331,536 A * 7/1994 Lane ..... 363/126
(Continued)

FOREIGN PATENT DOCUMENTS

CN 2428866 Y 5/2001
CN 101567250 A 10/2009
(Continued)

OTHER PUBLICATIONS

Office Action Dated May 20, 2015 of the Corresponding Chinese Patent Application No. 201210165051.0.

*Primary Examiner* — Elvin G Enad
*Assistant Examiner* — Kazi Hossain
(74) *Attorney, Agent, or Firm* — Chun-Ming Shih; HDLS IPR Services

(57) ABSTRACT

The present invention provides a transformer having assembled bobbins and a voltage transformation module having the transformer. The transformer includes a base, bobbins, secondary windings and two magnetic cores. The base is provided with a penetration hole. The bobbins are disposed in the base and each has an annular groove, a hollow portion corresponding to the penetration hole, and protrusions formed on a surface of the bobbin. The protrusions form a gap between the two adjacent bobbins when the two adjacent bobbins are assembled with each other. The secondary windings are disposed between the bobbins and each has a through-hole corresponding to the hollow portion. The two magnetic cores penetrate the penetration hole of the base, the hollow portions of the bobbins, and the through-holes of the secondary windings to assemble them together.

20 Claims, 4 Drawing Sheets

(51) Int. Cl.
*H01F 27/28* (2006.01)
*H01F 27/08* (2006.01)

(56) References Cited

U.S. PATENT DOCUMENTS 6,207,463 B1 * 3/2001 Tuunanen ..... 436/526
6,449,178 B1 * 9/2002 Sakai et al. ..... 363/131
6,522,233 B1 * 2/2003 Kyoso et al. ..... 336/200
7,439,839 B2 * 10/2008 Podlisk et al. ..... 336/200
8,395,470 B2 * 3/2013 Lin ..... 336/199
8,536,967 B2 * 9/2013 Kaneko ..... 336/198
8,648,687 B2 * 2/2014 Li et al. ..... 336/199
2007/0176722 A1 8/2007 Podlisk et al.
2012/0032770 A1 * 2/2012 Sohn et al. ..... 336/221

FOREIGN PATENT DOCUMENTS

CN 101847498 A 9/2010
JP 2012114302 * 6/2012

* cited by examiner

TRANSFORMER HAVING ASSEMBLED BOBBINS AND VOLTAGE TRANSFORMATION MODULE HAVING THE TRANSFORMER

CROSS-REFERENCE

This application is a continuous application of U.S. patent application Ser. No. 13/540,930, filed Jul. 3, 2012.

BACKGROUND OF THE INVENTION

1. Field of the Invention

The present invention relates to a transformer, and in particular to a transformer having assembled bobbins and a voltage transformation module having the transformer.

2. Description of Related Art

A transformer is an electronic component in which magnetic cores, primary windings and secondary windings are provided to generate electromagnetic induction for converting voltage. The conventional transformer includes a bobbin and two magnetic cores. The bobbin is formed into a hollow cylindrical shape and has an axial channel. Both ends of the bobbin extend to form a plurality of pins. Two sets of electric leads are wound around both ends of the bobbin adjacent to its corresponding pin in different turn numbers, thereby forming a primary winding and a secondary winding respectively. Then, the two magnetic cores are disposed on both ends of the bobbin respectively.

However, since the interior of the bobbin of the conventional transformer is an axial channel, an electric current or an induced current flowing the electric leads inevitably generates heat, and the heat will be accumulated inside the bobbin (i.e. in the axial channel). Such a problem of heat accumulation is more serious in a large-power transformer such as a 600-watt transformer. Since the conventional transformer is not provided with any heat-dissipating means, the heat accumulated inside the bobbin will cause the increase in its temperature after being operated for a period of time. Even, the performance of the transformer may be deteriorated by the rising temperature. A conventional solution is to mount a heat-dissipating fan outside the bobbin. However, both ends of the bobbin are blocked by the magnetic cores, so that the airflow generated by such an external fan can only blow the outer surface of the bobbin, but cannot dissipate the heat accumulated inside the bobbin. As a result, the temperature of the conventional transformer still rises after being operated for a period of time.

In addition to the issue of heat dissipation, the bobbin of the conventional transformer is integrally formed into one body. Thus, if the transformers of different sizes are to be manufactured, the manufacturer has to produce various bobbins of different sizes and respective casings corresponding to the various bobbins. As a result, the manufacturer has to spend a lot of money to design various molds for this purpose, which increases the production cost. Thus, the manufacturer proposes a transformer having combined bobbins, in which a plurality of bobbins is combined with each other. These bobbins are combined with or adhered to each other to thereby forming a bobbin assembly. However, such a conventional transformer having combined bobbins does not solve the problem of heat accumulation in the bobbin.

Therefore, it is an important issue for the present Inventor to solve the above-mentioned problems.

SUMMARY OF THE INVENTION

The present invention is to provide a transformer having assembled bobbins, which is capable of generating a better heat-dissipating effect to the bobbins therein. Further, its dimension can be flexibly adjusted to thereby reduce the production cost.

The present invention provides a transformer having assembled bobbins, including:

a plurality of bobbins each having an annular groove provided on its outer edge, a hollow portion, and a plurality of protrusions formed on a surface of the bobbin to surround the hollow portion, the protrusions forming a gap between the two adjacent bobbins when the two adjacent bobbins are assembled with each other;

a plurality of secondary windings disposed between the bobbins, each of the secondary windings having a through-hole corresponding to the hollow portion; and two magnetic cores penetrating the hollow portions of the bobbins and the through-holes of the secondary windings to assemble them together.

The present invention is to provide a voltage transformation module, which is capable of generating a better heat-dissipating effect to a transformed and bobbins therein. Further, its dimension can be flexibly adjusted to thereby reduce the production cost.

The present invention provides a voltage transformation module, including:

a transformer;

a temperature sensor disposed inside the transformer to detect the temperature of the transformer; and a heat-dissipating fan disposed outside the transformer to dissipate the heat generated by the transformer;

wherein the transformer further comprises:

a base provided with a penetration hole;

a plurality of bobbins each having an annular groove provided on its outer edge, a hollow portion corresponding to the penetration hole, and a plurality of protrusions formed on a surface of the bobbin to surround the hollow portion, the protrusions forming a gap between the two adjacent bobbins when the two adjacent bobbins are assembled with each other;

a plurality of secondary windings disposed between the bobbins, each of the secondary windings having a through-hole corresponding to the hollow portion; and two magnetic cores penetrating the penetration hole of the base, the hollow portions of the bobbins, and the through-holes of the secondary windings to assemble them together.

In comparison with prior art, the present invention has the following advantageous features:

The transformer of the present invention has a plurality of bobbins each formed with a plurality of protrusions on its one surface. The protrusions form a gap between the two adjacent bobbins when the two adjacent bobbins are assembled with each other. Such a gap facilitates air convection, whereby the heat generated by the windings of the bobbins can be dissipated to the outside of the transformer. Even the secondary windings are interposed between the two adjacent bobbins, the protrusions can still form a gap between the adjacent bobbin and the secondary winding. In this way, the heat accumulated between the adjacent bobbin and the secondary winding can be prevented, and airflow can freely flow through the gap formed by the protrusions between the adjacent bobbin and the secondary winding. Therefore, the structure of the present invention can reduce the heat accumulation in the bobbins and provide a better heat-dissipating effect to the bobbins and the secondary windings.

The voltage transformation module of the present invention further has a heat-dissipating fan for enhancing air convection. Thus, the heat generated by the transformer can be dissipated more sufficiently.

On the other hand, since the transformer of the present invention has a plurality of bobbins and secondary windings, the manufacturer merely produces various bases of different sizes and then assembles different numbers of the bobbins and the secondary windings into a desired base, thereby producing various transformers of different sizes. As a result, the size of the transformer of the present invention can be flexibly adjusted. Thus, the manufacturer needs not to design various bobbins and secondary windings of different sizes, so that the production cost can be reduced greatly.

DETAILED DESCRIPTION OF THE INVENTION

Figure 1:
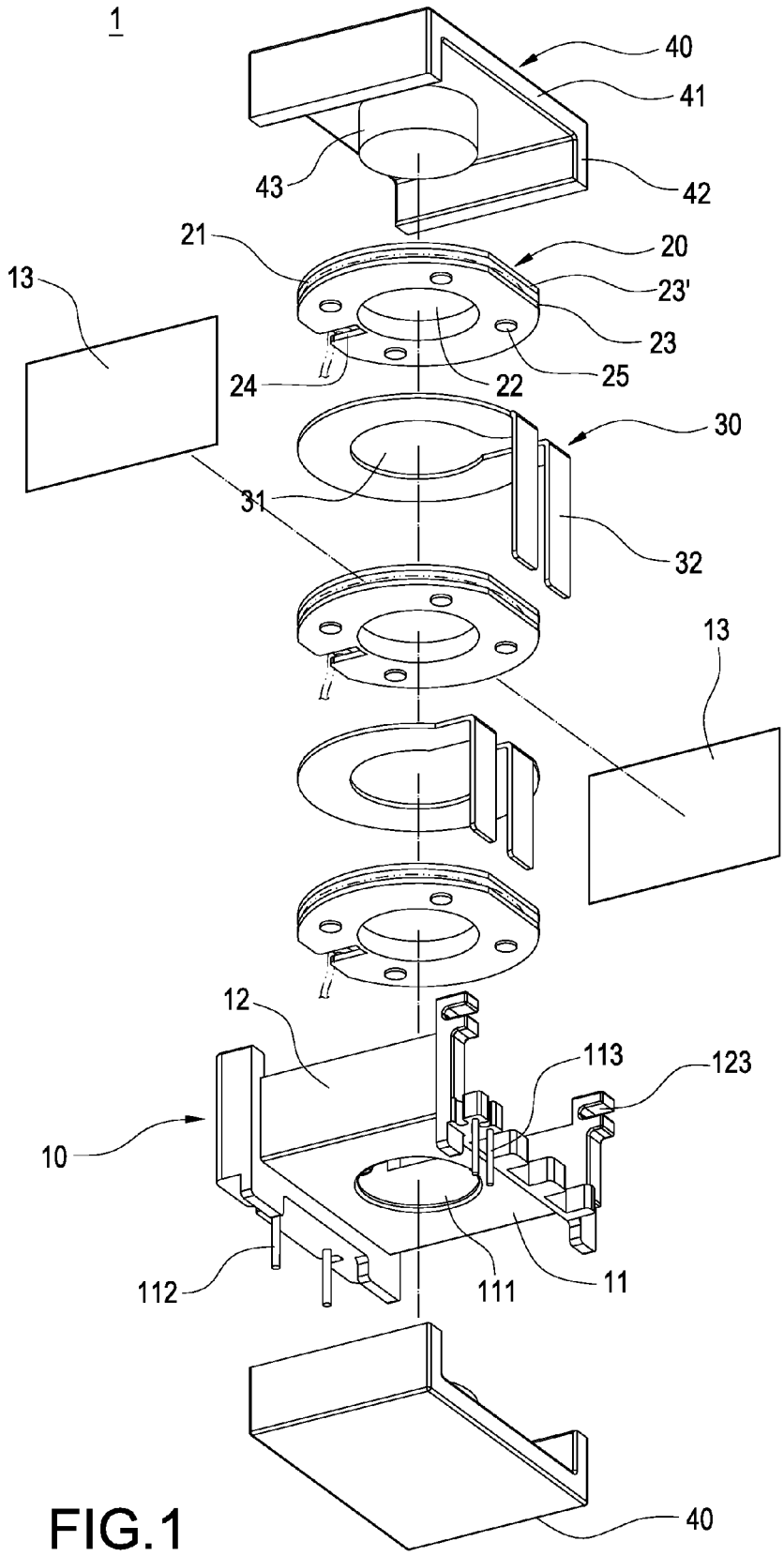
FIG. 1 is an exploded perspective view showing the transformer of the present invention.

The detailed description and technical contents of the present invention will become apparent with the following detailed description accompanied with related drawings. It is noteworthy to point out that the drawings is provided for the illustration purpose only, but not intended for limiting the scope of the present invention.

Please refer to FIGS. 1 to 6. The present invention provides a transformer 1 having assembled bobbins, which includes a base 10, a plurality of bobbins 20, a plurality of secondary windings 30, and two magnetic cores 40.

Figure 2:
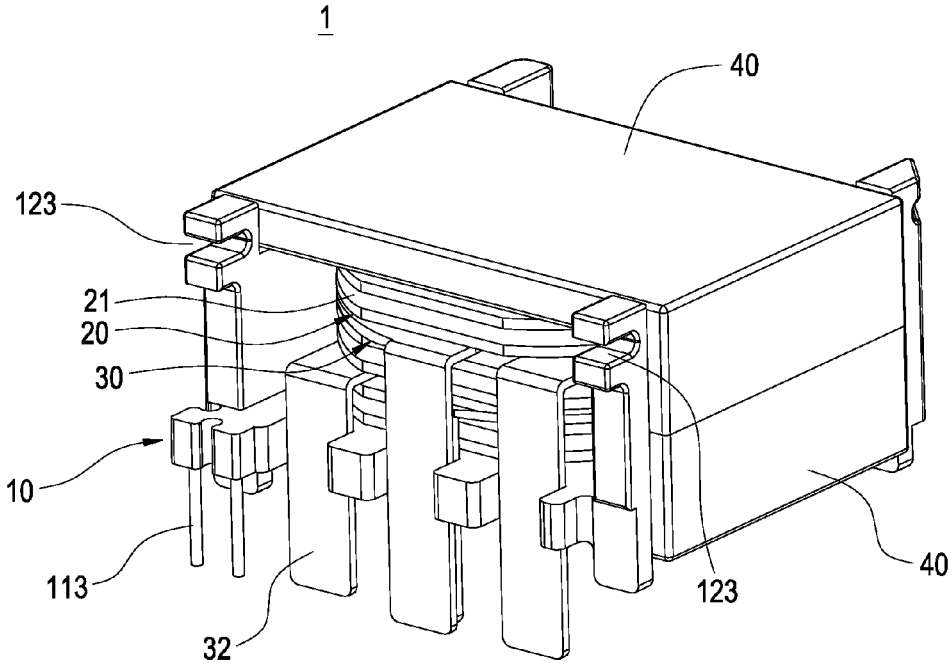
FIG. 2 is an assembled perspective view showing the transformer of the present invention.
Figure 3:
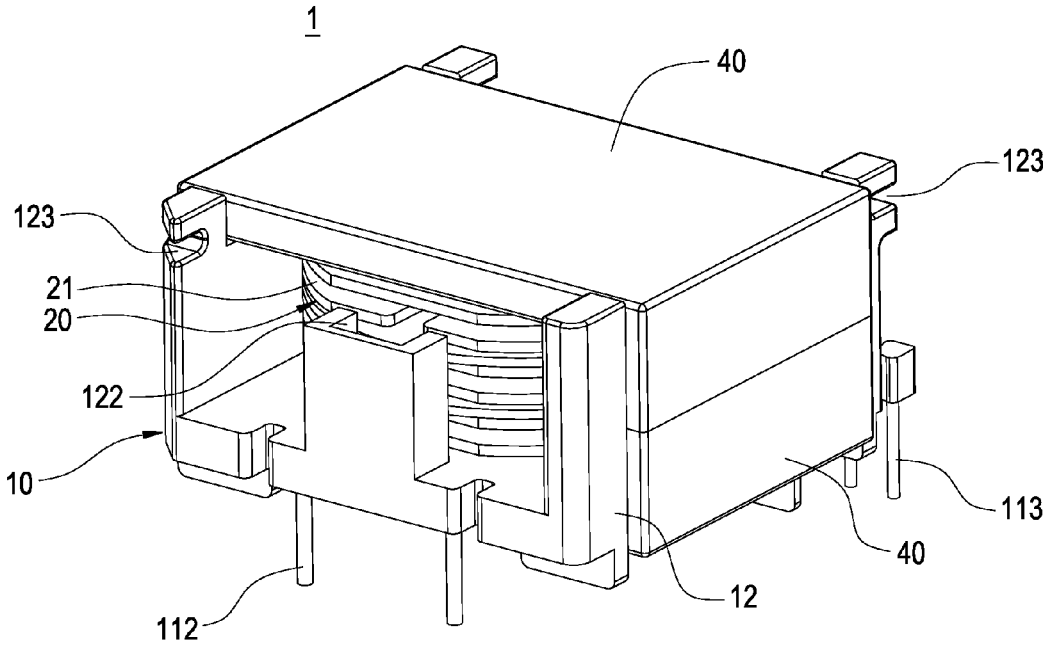
FIG. 3 is an assembled perspective view showing the transformer of the present invention taken along another viewing angle.
Figure 4:
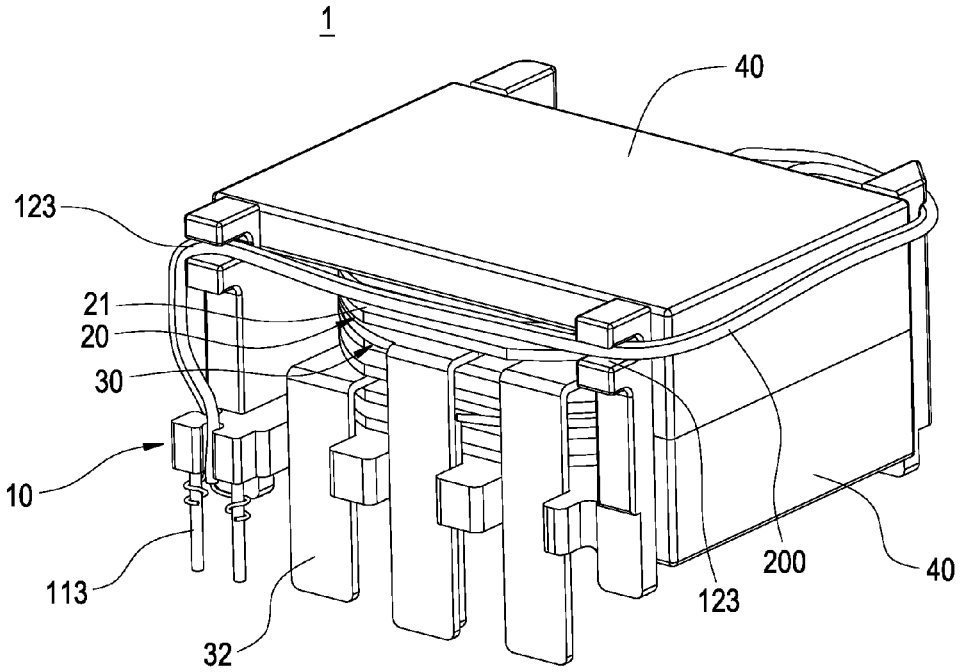
FIG. 4 is an assembled perspective view of the transformer of the present invention, showing that electric leads are wound around the bobbins to form windings.
Figure 5:
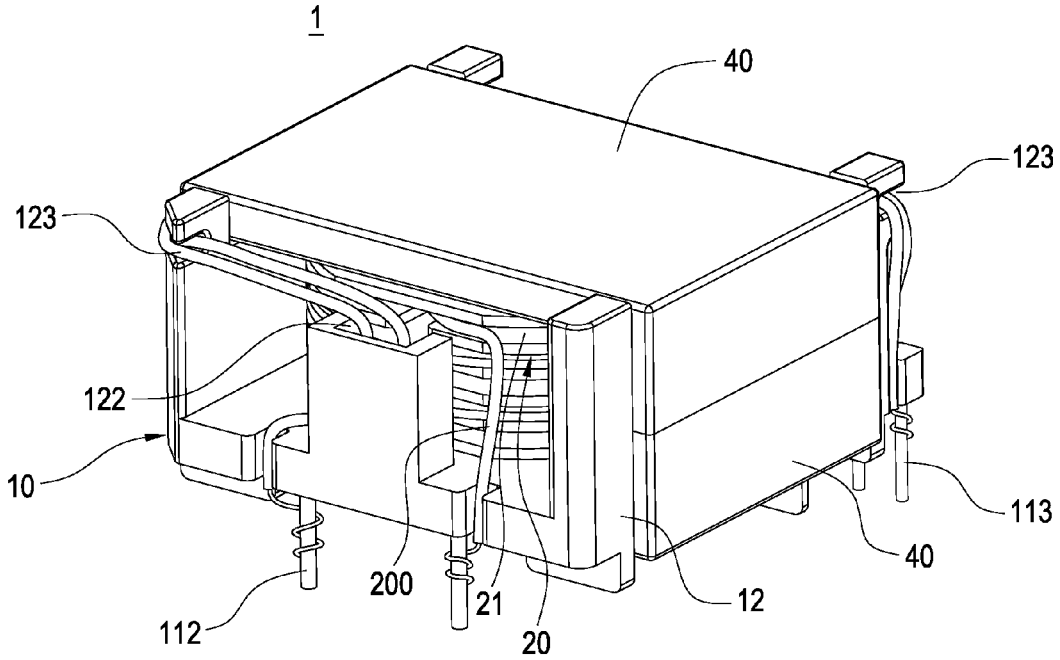
FIG. 5 is an assembled perspective view of the transformer of the present invention taken along another viewing angle, showing that electric leads are wound around the bobbins to form windings.

The base 10 includes a bottom plate 11 and two side plates 12 vertically extending from both sides of the bottom plate 11, respectively. The bottom plate 11 is provided with a penetration hole 111 as well as a plurality of first pins 112 and a plurality of second pins 113. Further, on two edges of the bottom plate 11 different from the two side plates 12, the bottom plate 11 of the base 10 is provided with a first groove 122 (FIG. 3) and a second groove 123 (FIG. 2). The first groove 122 is used to accommodate a temperature sensor 50 (FIG. 7), and the second groove 123 is used to allow electric leads of the temperature sensor 50 to pass through to thereby fix the electric leads of the temperature sensor 50 onto the base 10. The first pin 112 is electrically connected to primary windings (i.e. the bobbins 20 in the present invention), and the second pin 113 is used as an electrical-conductive path to the electric leads of the temperature sensor 50, thereby electrically connecting the temperature sensor 50 to a circuit board (not shown).

In the transformer 1 of the present invention, the positions and number of the first pins 112 and the second pins 113 may be adjusted based on practical demands. The positions and numbers of the first groove 122 and the second groove 123 may be adjusted based on practical demands. Thus, the drawings are used to illustrate an embodiment of the present invention only, but are not used to limit the scope of the present invention. However, it should be noted that the first pin 112 and the second pin 113 are provided on the base 10 rather than on the bobbins 20.

A plurality of bobbins 20 is disposed in the base 10. Each bobbin 20 is formed into a ring shape and has an annular groove 21 provided on its outer edge and a hollow portion 22 corresponding to the penetration hole 111 of the base 10. More specifically, as viewed from the side edge of the bobbin 20, the side surface of each bobbin 20 is substantially formed into an H shape and has two lateral plates 23 and 23'. The hollow portion 22 is a circular through-hole. Thus, the annular groove 21 is enclosed by the two lateral plates 23, 23' and the circular outer wall of the hollow portion 22. An electric lead 200 is wound in the annular groove 21. An end of each bobbin 20 is formed with a notch 24 on the lateral plates 23 and 23' respectively. The electric lead 200 passes through one of the notches 24 to be wound around the annular groove 21 and penetrates through the other notch 24 to be electrically connected to other portions of the transformer.

At least one surface (i.e. lateral plate 23) of each bobbin 20 is formed with a plurality of protrusions 25. The protrusions 25 are arranged to surround the hollow portion 22 at intervals. Preferably, the protrusions 25 are uniformly distributed on the lateral plate 23. The protrusions 25 protrude from the lateral plate 23 by a distance, whereby a gap can be formed between two adjacent bobbins 20 when they are assembled with each other. The gap is used to facilitate the air convection between the adjacent two lateral plates 23 to thereby enhance the heat-dissipating effect to the bobbins 20. The bobbins 20 may be made of insulating materials (such as plastic) or electrical conductive materials (such as metals). Two edges inside the base 10 are adhered with an insulation piece 13 such as Mylar tapes commonly used in this industry.

The plurality of secondary windings 30 is arranged between adjacent two bobbins 20. Each of the secondary windings 30 is formed into a C-shaped electrical conductive piece and has a through-hole 31 corresponding to the hollow portion 22 of the bobbin 20. An end of the secondary winding 30 is bent to form two folded pieces 32. The two folded pieces 32 are used to be fixed onto the bottom plate 11 of the base 10 for position. It can be clearly seen that, the folded pieces 32 of each secondary winding 30 may be designed to have different lengths, so that the two folded pieces 32 can be arranged on one side edge of the base 10 in a staggered manner.

It should be noted that, as shown in FIG. 1, when the bobbin 20 is disposed in the base 10 and the secondary windings 30 are respectively disposed between the adjacent two bobbins 20, the protrusions 25 of each bobbin 20 are formed on the same side (the surface of the lateral plate 23 facing downward in FIG. 1). By this arrangement, the protrusions 25 of the bobbin 20 can abut against the secondary winding 30 to form a gap 26 (FIG. 6) between the bobbin 20 and the secondary winding 30. Although the protrusions 25 of the lowest bobbin 20 do not abut against the secondary winding 30, they abut against the bottom plate 11 to still generate a gap 27 between the bobbin 20 and the bottom plate 11. Such a gap 26 or 27 between the bobbin 20 and the bottom plate 11 also facilitates the air convection for heat dissipation.

In the present invention, the bobbins 20 are used as primary windings, and the secondary windings 30 are used as secondary windings. Although the bobbins 20 and the secondary windings 30 are arranged in a staggered manner as shown in FIG. 1, it could be understood that the bobbins 20 and the secondary windings 30 may be arranged to be adjacent to each other as long as their electric leads are connected correctly. In the present invention, since the bobbins 20 and the secondary windings 30 can be freely assembled together, and each of the bobbins 20 is not provided with the first pin 112 and the second pin 113, the size and voltage conversion ratio of the transformer having assembled bobbins can be flexibly adjusted. Unlike prior art, in the present invention, it is not necessary to design various bobbins of different sizes, nor to winding the electric leads around the bobbins by different turn numbers. Therefore, the production cost is reduced while the production efficiency is increased greatly.

Each of the magnetic cores 40 has an E shape and made of magnetic materials such as an iron core. The magnetic core 40 may be one of ATQ type, EE type, ER type, ERI type, ECI type, RM type, EQ type, PQ type, PJ type and PM type magnetic cores. The magnetic core 40 has a primary bottom plate 41 and two side wing plates 42 vertically extending from the primary bottom plate 41. The primary bottom plate 41 is formed with a magnetic shaft 43 whose outer diameter is slightly smaller than the inner diameter of the penetration hole 111, the hollow portion 22, and the through-hole 31. By this arrangement, the two magnetic cores 40 can pass through the penetration hole 111 of the base 10, the hollow portions 22 of the bobbins 20, and the through-holes 31 of the secondary windings 30 to thereby assemble them together.

Figure 6:
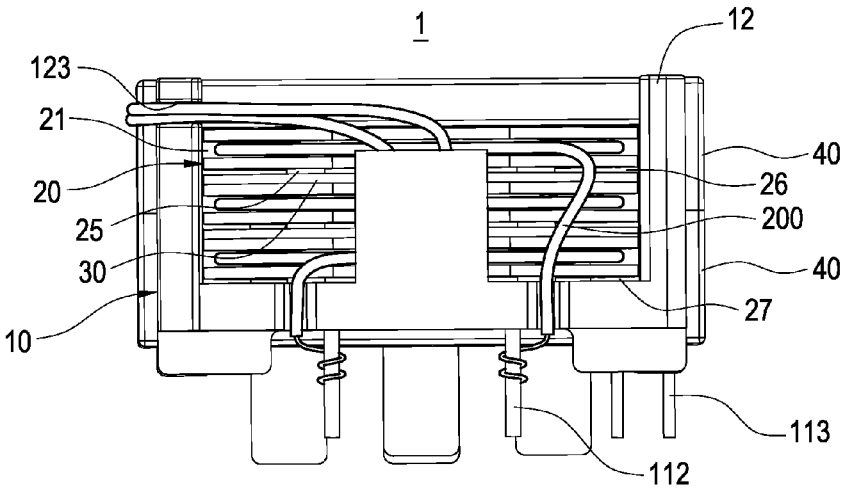
FIG. 6 is a front view of the transformer of the present invention, showing that electric leads are wound around the bobbins to form windings.

It should be noted that, the two side wing plates 42 of each magnetic core 40 are formed to cover the two side plates 12 of the base 10 respectively. By this arrangement, the air can freely flow in the direction parallel to the two side plates 12 of the base 10 and the two side wing plates 42 of the magnetic core 40 without being blocked by other plates. As shown in FIG. 6, the air can flow in the direction parallel to the two side plates 12 of the base 10, and thus flow through the gaps 26 formed by the protrusions 25 between the bobbins 20 and the secondary windings 30. In this way, the heat generated by the windings on the bobbins 20 can be dissipated to the outside of the transformer 1 by the airflow.

Although the bobbins 20 and the secondary windings 30 are stacked up to form a vertical-type transformer 1 in FIG. 1, it could be understood that, the bobbins 20 and the secondary windings 30 may be arranged side-by-side relative to each other to form a horizontal-type transformer 1 with the first pins 112 and the second pins 113 bent downwardly.

Figure 7:
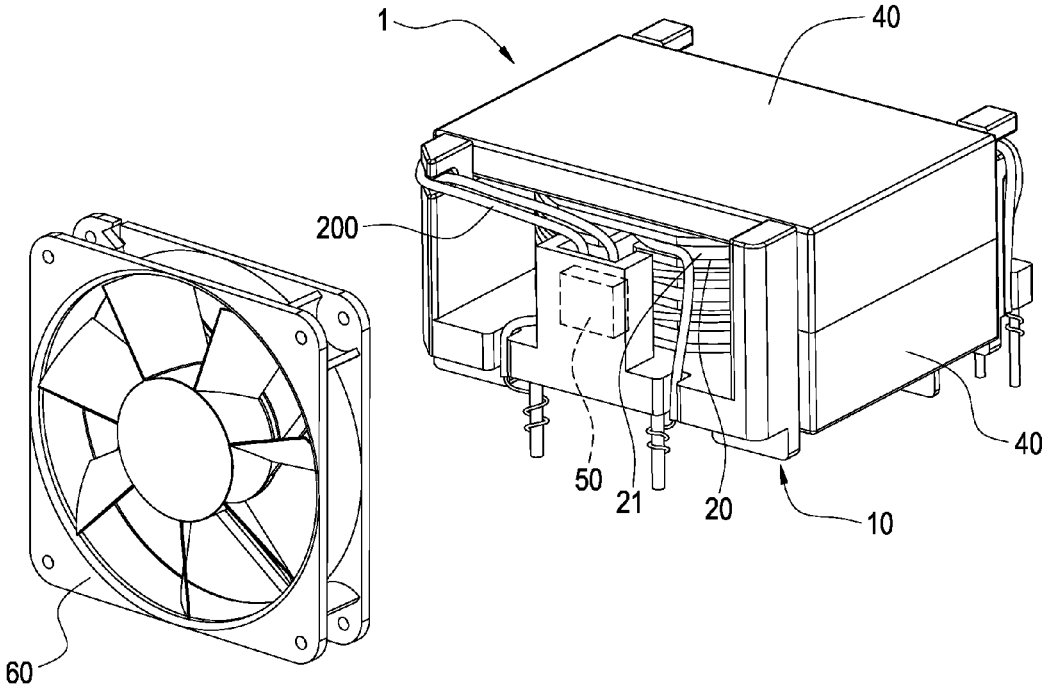
FIG. 7 is an exploded perspective view showing the voltage transformation module of the present invention.

Please refer to FIG. 7. The present invention further provides a voltage transformation module 2 including the above-mentioned transformer 1, a temperature sensor 50, and a heat-dissipating fan 60. The temperature sensor 50 is disposed in the first groove 122 of the transformer 1 to detect the temperature of the transformer 1. The heat-dissipating fan 60 is disposed outside the transformer 1 to dissipate the heat of the transformer 1 to the outside. More specifically, the heat-dissipating fan 60 may be arranged on one side of the transformer 1 in parallel to the two side plates 12 of the base 10. By this arrangement, the airflow generated by the heat-dissipating fan 60 can pass through the gaps 26 formed by the protrusions 25 between the bobbins 20 and the secondary windings 30, thereby dissipating the heat generated by the windings of the bobbins 20 to the outside of the transformer 1. Therefore, the present invention has an excellent heat-dissipating effect.

Although the present invention has been described with reference to the foregoing preferred embodiments, it will be understood that the invention is not limited to the details thereof. Various equivalent variations and modifications can still occur to those skilled in this art in view of the teachings of the present invention. Thus, all such variations and equivalent modifications are also embraced within the scope of the invention as defined in the appended claims.

What is claimed is:

1. A transformer having assembled bobbins, including:

a plurality of bobbins each having an annular groove provided on its outer edge and a hollow portion;

a plurality of secondary windings disposed between two adjacent bobbins, each of the secondary windings having a through-hole corresponding to the hollow portion;

a plurality of protrusions formed on a surface of one bobbin, the surface being faced to a corresponding secondary winding, to surround the hollow portion, the protrusions abutting against the corresponding secondary winding so that a gap is formed between the two adjacent bobbins by the protrusions when the two adjacent bobbins are assembled with each other, wherein the gap is used to facilitate an air convection between the two adjacent bobbins to thereby enhance the heat-dissipating effect to the bobbins; and two magnetic cores penetrating the hollow portions of the bobbins and the through-holes of the secondary windings to assemble them together.

2. The transformer having assembled bobbins according to claim 1, further including a base provided with a penetration hole, the hollow portion of each of the bobbins being positioned to correspond to the penetration hole, each of the magnetic cores passing through the penetration hole of the base and the hollow portions of the bobbins to assemble them together.

3. The transformer having assembled bobbins according to claim 2, wherein each of the bobbins has two lateral plates, the hollow portion is a through-hole, the annular groove is enclosed by the two lateral plates and outer walls of the hollow portion, and the protrusions are formed on at least one of the lateral plates.

4. The transformer having assembled bobbins according to claim 3, wherein the protrusions are uniformly distributed on the at least one lateral plate.

5. The transformer having assembled bobbins according to claim 4, wherein the protrusions of each bobbin are formed on the same side when the bobbins are disposed in the base and the secondary windings are disposed between the adjacent two bobbins.

6. The transformer having assembled bobbins according to claim 3, wherein an end of each bobbin is provided with a notch on the lateral plates respectively, and an electric lead passes through one of the notches to be wound around the annular groove and penetrates the other one of the notches.

7. The transformer having assembled bobbins according to claim 3, wherein each of the secondary windings is a C-shaped electrical conductive piece, anone end of the secondary winding is bent to form two folded pieces.

8. The transformer having assembled bobbins according to claim 6, wherein the base includes a bottom plate and two side plates vertically extending from both sides of the bottom plate, the bottom plate is provided with the penetration hole, a plurality of first pins and a plurality of second pins, and two edges inside the base are adhered with an insulation piece respectively.

9. The transformer having assembled bobbins according to claim 8, wherein two sides of the bottom plate different from the side plates are provided with at least one first groove and at least one second groove.

10. The transformer having assembled bobbins according to claim 9, wherein each of the magnetic cores has an E shape and is made of magnetic materials, each magnetic core has a primary bottom plate and two side wing plates vertically extending from the primary bottom plate, the two side wing plates are formed to cover the two side plates of the base, and the primary bottom plate is formed with a magnetic shaft whose outer diameter is smaller than the inner diameter of the penetration hole, the hollow portion and the through-hole.

11. The transformer having assembled bobbins according to claim 9, wherein each of the magnetic cores is one selected from ATQ type, EE type, ER type, ERI type, ECI type, RM type, EQ type, PQ type, PJ type and PM type magnetic cores.

12. A voltage transformation module, including:

a transformer;

a temperature sensor disposed inside the transformer to detect the temperature of the transformer; and a heat-dissipating fan disposed outside the transformer to dissipate the heat generated by the transformer;

wherein the transformer further comprises:

a base provided with a penetration hole;

a plurality of bobbins each having an annular groove provided on its outer edge and a hollow portion corresponding to the penetration hole;

a plurality of secondary windings disposed between the bobbins, each of the secondary windings having a through-hole corresponding to the hollow portion; and a plurality of protrusions formed on a surface of one bobbin, the surface being faced to a corresponding secondary winding, to surround the hollow portion, the protrusions abutting against the corresponding secondary winding so that a gap is formed between the two adjacent bobbins by the protrusions when the two adjacent bobbins are assembled with each other, wherein the gap is used to facilitate an air convection between the two adjacent bobbins to thereby enhance the heat-dissipating effect to the bobbins;

two magnetic cores penetrating the penetration hole of the base, the hollow portions of the bobbins, and the through-holes of the secondary windings to assemble them together.

13. The voltage transformation module according to claim 12, wherein each of the bobbins has two lateral plates, the hollow portion is a through-hole, the annular groove is enclosed by the two lateral plates and outer walls of the hollow portion, and the protrusions are formed on at least one of the lateral plates.

14. The voltage transformation module according to claim 13, wherein the protrusions of each bobbin are formed on the same side when the bobbins are disposed in the base and the secondary windings are disposed between the adjacent two bobbins.

15. The voltage transformation module according to claim 13, wherein an end of each bobbin is provided with a notch on the lateral plates respectively, and an electric lead passes through one of the notches to be wound around the annular groove and penetrates the other one of the notches.

16. The voltage transformation module according to claim 13, wherein each of the secondary windings is a C-shaped electrical conductive piece, and one end of the secondary winding is bent to form two folded pieces.

17. The voltage transformation module according to claim 15, wherein the base includes a bottom plate and two side plates vertically extending from both sides of the bottom plate, the bottom plate is provided with the penetration hole, a plurality of first pins and a plurality of second pins, and two edges inside the base are adhered with an insulation piece respectively.

18. The voltage transformation module according to claim 17, wherein two sides of the bottom plate different from the side plates are provided with at least one first groove and at least one second groove.

19. The voltage transformation module according to claim 18, wherein each of the magnetic cores has an E shape and is made of magnetic materials, each magnetic core has a primary bottom plate and two side wing plates vertically extending from the primary bottom plate, the two side wing plates are formed to cover the two side plates of the base, and the primary bottom plate is formed with a magnetic shaft whose outer diameter is smaller than the inner diameter of the penetration hole, the hollow portion and the through-hole.

20. The voltage transformation module according to claim 19, wherein each of the magnetic cores is one selected from ATQ type, EE type, ER type, ERI type, ECI type, RM type, EQ type, PQ type, PJ type and PM type magnetic cores.

* * * * *